US006023894A

United States Patent [19]

Sorkin

[11] Patent Number: 6,023,894

[45] Date of Patent: Feb. 15, 2000

[54] ANCHOR OF A POST-TENSION ANCHORAGE SYSTEM WITH AN IMPROVED CAP CONNECTION

[76] Inventor: Felix L. Sorkin, 4115B Greenbriar Dr., P.O. Box 1503, Stafford, Tex. 77477

[21] Appl. No.: 09/007,601

[22] Filed: Jan. 15, 1998

[51] Int. Cl.[7] ..... E04C 5/12

[52] U.S. Cl. ..... 52/223.8; 52/223.13; 24/122.6; 249/43; 249/217

[58] Field of Search ..... 52/223.8, 223.9, 52/223.13, 220.8, 253; 74/502.6, 553; 411/429; 24/122.6, 113 MP; 249/43, 217

[56] References Cited

U.S. PATENT DOCUMENTS

| | | | |
|---|---|---|---|
| 3,844,697 | 10/1974 | Edwards | 52/223.13 X |
| 4,059,931 | 11/1977 | Mongan | 52/233.9 X |
| 4,719,658 | 1/1988 | Kriofske | 52/233.13 |
| 4,773,198 | 9/1988 | Reinhardt | 52/233.13 |
| 4,918,887 | 4/1990 | Davis et al. | 52/233.13 |
| 4,998,760 | 3/1991 | Nixon et al. | 292/347 |
| 5,072,558 | 12/1991 | Sorkin et al. | 52/233.13 |
| 5,347,777 | 9/1994 | Sudduth | 52/233.13 |
| 5,440,842 | 8/1995 | Sorkin | 52/233.13 |
| 5,755,065 | 5/1998 | Sorkin | 52/233.13 |

FOREIGN PATENT DOCUMENTS

| | | | |
|---|---|---|---|
| 122197 | 10/1984 | European Pat. Off. | 52/233.13 |

*Primary Examiner*—Carl D. Friedman
*Assistant Examiner*—Winnie Yip
*Attorney, Agent, or Firm*—Harrison & Egbert

[57] ABSTRACT

An anchor for a post-tension anchorage system includes an anchor member with an end surface, a polymeric encapsulation covering the anchor member having a tubular section extending outwardly from the end surface of the anchor member, and an improved cap having a generally tubular body with an open end and a closed end. The tubular section of the encapsulation includes an inwardly extending protrusion. The improved cap has a flanged end adjacent an open end of the tubular body of the cap. This flanged end has a circumferential surface. A locking member is formed on the circumferential surface for detachably engaging the protrusion such that the flanged end is fixedly received within the tubular section. A compressible seal is affixed within the polymeric encapsulation and extends around the end surface. The cap has an annular surface extending around the open end and in compressible contact with the compressible seal when the locking member engages the protrusion.

15 Claims, 2 Drawing Sheets

ANCHOR OF A POST-TENSION ANCHORAGE SYSTEM WITH AN IMPROVED CAP CONNECTION

TECENICAL FIELD

The present invention relates generally to post-tension anchorage systems. More particularly, the present invention relates to caps that are used for closing an end of the anchor and for encapsulating an exposed end of a tendon extending through the anchor. Furthermore, the present invention relates to improved locking mechanisms for causing the cap to be properly joined to the polymeric encapsulation of the anchor.

BACKGROUND ART

For many years, the design of concrete structures imitated typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive (vertical) load, is extremely weak in carrying significant tensile loads. It becomes necessary, therefore, to add steel bars, called reinforcements, to concrete, thus allowing the concrete to carry the compressive forces and the steel to carry the tensile (horizontal) forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as 100 feet can be attained in members as deep as three feet for roof loads. The basic principal is simple. In pre-stressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principal, but the reinforcing is held loosely in place while the concrete is placed around it. The reinforcing is then stretched by hydraulic jacks and securely anchored into place. Prestressing is done with individual members in the shop and post-tensioning as part of the structure on the site.

In a typical tendon tensioning anchor assembly in such post-tensioning operations, there is provided a pair of anchors for anchoring the ends of the tendons suspended therebetween. In the course of installing the tendon tensioning anchor assembly in a concrete structure, a hydraulic jack or the like is releasably attached to one of the exposed ends of the tendon for applying a predetermined amount of tension to the tendon. When the desired amount of tension is applied to the tendon, wedges, threaded nuts, or the like, are used to capture the tendon and, as the jack is removed from the tendon, to prevent its relaxation and hold it in its stressed condition.

Metallic components within concrete structures may be come exposed to many corrosive elements, such as de-icing chemicals, sea water, brackish water, or spray from these sources, as well as salt water. If this occurs, and the exposed portions of the anchor suffer corrosion, then the anchor may become weakened due to this corrosion. The deterioration of the anchor can cause the tendons to slip, thereby losing the compressive effects on the structure, or the anchor can fracture. In addition, the large volume of by-products from the corrosive reaction is often sufficient to fracture the surrounding structure. These elements and problems can be sufficient so as to cause a premature failure of the post-tensioning system and a deterioration of the structure.

Various attempts have been made in the prior art to reduce or eliminate the potential for corrosion within the wedge cavity of the anchor. For example, U.S. Pat. No. 5,024,032, entitled "Post-Tensioning Anchor" and issued to Rodriguez on Jun. 18, 1991, discloses a post-tension anchor and cap. The cap friction fits with the anchor in an effort to enclose the wedge cavity from external materials. The friction-fitting cap includes tabs or so-called "ears" around which securing filaments are tied. The securing filaments are purported to retain the cap within a press-fit engagement of the anchor, thereby precluding corrosives or contaminants from reaching the wedge cavity of the anchor.

U.S. Pat. No. 4,918,887, entitled "Protective Tendon Tensioning Anchor Assembly" and issued to Davis et al. on Apr. 24, 1990, discloses the combination of an anchor plate, a sealing cap and a resilient sealing ring. The combination is used in an effort to seal the wedge assembly of the anchor from the external environment. The combination represents a relatively complicated configuration for a sealing cap wherein various locking fingers and a specially shaped sealing ring are necessary in an effort to seal the wedge cavity of the anchor from external contaminants.

As yet another example, U.S. Pat. No. 4,773,198, entitled "Post-Tensioning Anchorages for Aggressive Environments", and issued to Reinhardt on Sep. 27, 1988, discloses an alternative anchor and sealing cap assembly. The sealing cap is provided with threads for threading into a lip of the anchor plate for fluid sealing. Alternative seals such as "snap rings, bayonet fittings or other" fittings are also discussed.

As yet a final example, U.S. Pat. No. 4,719,658, entitled "Hermetically Sealed Anchor Construction For Use In Post Tensioning Tendons", and issued to Kriofske on Jan. 19, 1988, discloses an anchor and "plug" for fitting to the anchor. The plug includes a grease fitting through which grease may be injected, thereby forcing it into the cavities surrounding the anchor.

U.S. Pat. No. 5,440,842, issued on Aug. 15, 1995, to the present inventor, describes one technique for sealing and anchor. In this patent, a cap is provided with a O-ring seal disposed inwardly of a lip at the end of the cap. When the cap is pushed into the interior of the tubular section of the anchor, the elastomeric seal will engage the walls of the tubular section in generally friction-fit relationship. As such, the cap will be retained properly in place. Unfortunately, this device could be easily dislodged or improperly placed. It is also possible that the cap could be improperly installed and this improper installation would not be noticeable upon inspection. As such, a need developed for a positive snap-fit connection between the cap and the anchor.

Each of the prior art references discussed above, as well as others known in the art, all purport to attempt to maintain the wedge cavity of the anchor free of contaminants. Unfortunately, however, each of the efforts of the prior art have reflected various drawbacks. For example, many of the devices are highly complicated to manufacture and/or use. This increased complication significantly increases costs which, when spread over hundreds or thousands or thousands of devices, may significantly affect the total price for constructing the concrete structure. Moreover, the more sophisticated devices require greater skill and time expenditure during installation. Consequently, not only are costs of the device increased, but so are the risks of wrongful or erroneous use of the device. If the device is not properly implemented, the device may fail to achieve its intended objective.

It is an object of the present invention to provide an improved cap and anchor which assures a positive connection between the cap and the anchor.

It is another object of the present invention to provide an improved cap and anchor that assures the liquid-tight engagement of the cap with the anchor.

It is a further object of the present invention to provide an improved cap which cannot be easily removed without a positive intended action for removal from the anchor.

It is still another object of the present invention to provide an improved cap which is easy to install into the anchor.

It is still a further object of the present invention to provide an improved cap and anchor which is easy to manufacture, easy to use, and relatively inexpensive.

These and other objects and advantages of the present invention will become apparent from a reading of the attached specification and appended claims.

SUMMARY OF THE INVENTION

The present invention is an improved cap for an anchor of a post-tension anchorage system. The anchor includes an anchor member having an end surface, a polymeric encapsulation covering the anchor member such that the polymeric encapsulation forms a tubular section extending outwardly of the end surface of the anchor member, a cap having a generally tubular body with an open end and a closed end, and a locking means formed on the cap. The polymeric encapsulation has an inwardly extending protrusion formed on the tubular section. The cap has a flanged end adjacent to the open end. This flanged end has a circumferential surface. The locking means is formed on the circumferential surface so as to detachably engage the protrusion such that the flanged end is fixedly received within the tubular section. A compressible seal is affixed within the polymeric encapsulation and extends around the end surface. The cap has an annular surface extending around the open end. This annular surface is in compressive contact with the compressible seal when the locking means engages the protrusion. This compressible seal is an annular seal formed of an elastomeric material. The cap is in liquid-tight engagement with the encapsulation and over the anchor member when the locking means engages the protrusion.

In the present invention, the locking means includes a receptacle area formed on the circumferential surface. This receptacle area has a size slightly greater than that of the protrusion. Specifically, the receptacle area includes a slide surface, an abutment member connected to the slide surface, and a locking member formed on an end of the slide surface opposite the abutment member. The slide surface has an edge extending for a portion of a circumference of the flanged end. The slide surface is parallel to an edge of the flanged end. The locking member has a spearhead shape. The spearhead shape has a wide end facing the abutment member. The receptacle area is defined by the wide end and by the abutment member and by a portion of the slide surface extending between the wide end and the abutment surface. A plurality of receptacle areas are formed around the circumferential surface. These receptacle areas engage corresponding protrusions formed on the tubular section of the polymeric encapsulation.

DETAILED DESCRIPTION OF THE INVENTION

Figure 1:
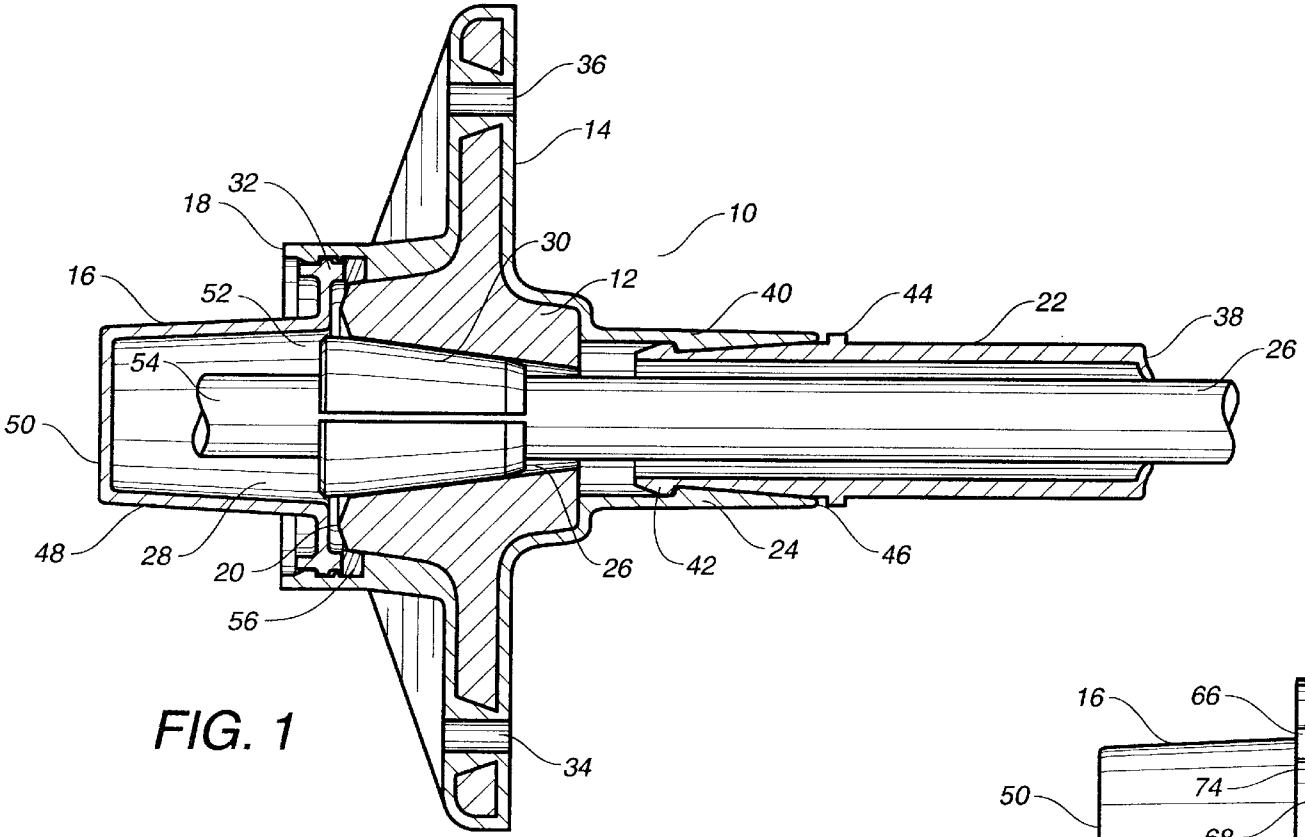
FIG. 1 is a cross-sectional view showing the post-tension system of the present invention.

Referring to FIG. 1, there is shown at 10 the post-tension system in accordance with the teachings of the present invention. The post-tension system 10 includes an anchor member 12, a polymeric encapsulation 14 covering the anchor member 12, a cap 16 affixed to an end 18 of the polymeric encapsulation 14 and over an end surface 20 of the anchor member 12 and a corrosion protection tube 22 extending outwardly of a tubular member 24 formed at an end of the encapsulation 14 opposite tubular section 18. A tendon 26 extends through the interior of the corrosion protection tube 22, through an interior of the tubular member 24, through a wedge cavity 26 of the anchor member 12 and outwardly into an interior 28 of the cap 16. Wedges 30 serve to engage the tendon 26 in friction-fit receipt within the tapered wedge-receiving cavity 26 of the anchor 12.

The anchor member 12 is a steel anchor of a standard construction. The anchor member 12 is covered with the encapsulation 14 by an injection molding process. The tubular member 24 is formed of the encapsulation material 14 so as to extend outwardly from one end of the anchor member 12. The tubular section 18 extends outwardly from the opposite end of the anchor member 12. The tubular section 18 serves to receive a flanged end 32 of the cap 16. The encapsulation 14 and the anchor member 12 includes holes 34 and 36 so as to facilitate the ability to properly affix the anchor member 12 to an exterior surface.

As can be seen in FIG. 1, the corrosion protection tube 22 is in snap-fit engagement within the tubular member 24. The corrosion protection tube 22 includes a sealing mechanism 38 formed at an end of the corrosion protection tube 22 opposite the anchor member 12. The sealing mechanism 38 serves to prevent liquid intrusion from entering the area between the exterior 26 and the interior of the corrosion protection tube 22. A shoulder 40 is formed interior of the tubular member 24 so as to be in snap-fit engagement with a spearhead end 42 of the corrosion protection tube 22. The corrosion protection tube 22 can be installed by simply sliding the corrosion protection tube 22 inwardly of the tubular member 24 until this snap-fit engagement occurs. An external shoulder 44 will reside in close proximity to an end 46 of the tubular member 24.

In FIG. 1, it can be seen that the cap 16 has a generally tubular body 48 with a closed end 50 and an open end 52. The exposed end 54 of tendon 26 will extend through the open end 52 of cap 16 and terminate prior to the closed end 50. The flanged end 32 is in locking receipt within the tubular section of the encapsulation 14. A compressible seal 56 is affixed within the encapsulation 14 and extends around the end surface 20 of the anchor member 12. The compressible seal 56 is formed of a compressible elastomeric material. As can be seen, the end of the cap 16 is in compressive contact with the compressible seal 56 so as to establish a liquid-tight engagement between the cap 16 and the tubular section 18 of the encapsulation 14. As such, liquid intrusion into the interior of the post-tension system 10 is prevented.

Figure 2:
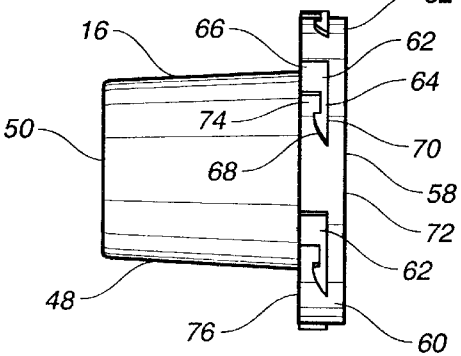
FIG. 2 is an isolated side elevational view of the improved cap of the present invention.

The present invention employs a unique form of a locking member for assuring a positive intended connection between the cap member 16 and the tubular section 18 of the encapsulation 14 and the anchor member 12. FIG. 2 illustrates this special locking mechanism with particularity. In FIG. 2, it can be seen that the cap member 16 has a generally tubular body 48. The tubular body 48 is slightly tapered so as to facilitate injection molding construction. The closed end 50 is formed at one end of the tubular body 48. Aniopen end 58 is formed at the opposite end of the tubular body 48. Flanged end 32 extends annularly outwardly from the tubular body 48. A circumferential surface 60 is formed on the flanged end 32.

A plurality of locking mechanisms 62 are formed on the circumferential surface 60 of the flanged end 32. Each of the locking mechanisms 62 includes a slide surface 64, an abutment member 66 and a locking member 68. The abutment member 66 is connected to the slide surface 64. The locking member 68 is formed at an end of the slide surface 64 opposite the abutment member 66. The slide surface 64 has an edge 70 extending for a portion of the circumference of the flanged end 32. This slide surface is parallel to the edge 72 of the open end 58. A receptacle area 74 is formed by the relationship between the abutment surface 66, the slide surface 64 and the locking member 68. The locking member 68 has a spearhead shape. This spearhead shape has a wide end facing the abutment member 66. The receptacle area 74 is defined by the wide end of the locking member 68, and by the abutment member 66 and by a portion of the slide surface 64. The receptacle area 74 will have a slightly greater area than an area of a protrusion formed in the tubular section 18 of the encapsulation 14 (to be described hereinafter). A plurality of locking mechanisms 62 around the circumferential area 60 of the flanged end 32 in evenly spaced relationship. The circumferential surface 60 has a forward edge 72 which is aligned with the open end 58 and a rearward edge 76 which is positioned between the open end 58 and the closed end 50. The circumferential surface 60 has a diameter which is greater than that of the tubular body 48. The slide surface 64 is spaced from and in parallel relationship to the forward edge 72. The abutment surface 66 extends from the slide surface 64 to the rearward edge 76.

Figure 3:
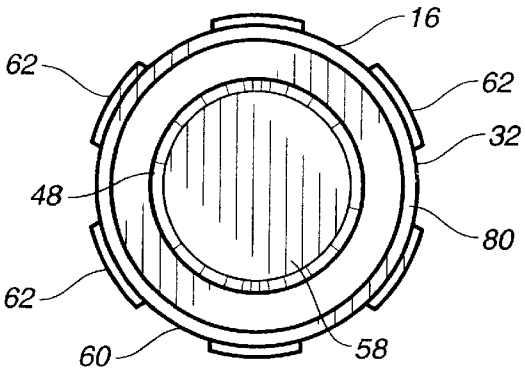
FIG. 3 is an end view of the improved cap of the present invention.

FIG. 3 shows an end view as taken from the open end 58 of the cap 16. It can be seen that the locking mechanisms 62 are evenly spaced from each other around the circumferential surface 60 of the flanged end 32. An annular surface 80 extends inwardly from the edge of the circumferential surface 60. This annular surface 80 will be in compressive contact with the annular seal 56 in the encapsulation 14. It can be seen that the open end 50 opens into the interior of the tubular body 48 of cap 16.

Figure 4:
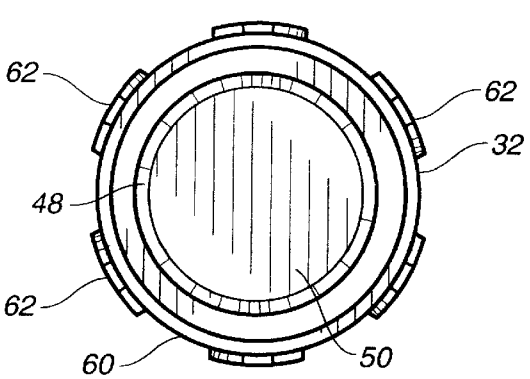
FIG. 4 is an opposite end view of the improved cap of the present invention.

FIG. 4 shows another end view as taken from the closed end 50 of the cap 16. It can be seen that the flanged end 32 extends outwardly from the outer diameter of the tubular portion 48. Circumferential surface 60 is formed on the outer periphery of the flanged end 32. Each of the locking mechanisms 62 are formed on the circumferential surface 60 and are evenly spaced from each other around the circumference of the flanged end 32.

Figure 5:
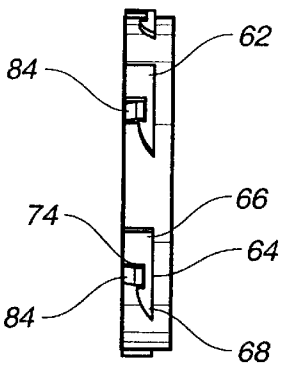
FIG. 5 is a detailed view showing the joining of the locking members with the protrusions.

FIG. 5 is a detailed illustration of how the locking mechanism 62 engages a protrusion 84 formed so as to extend inwardly of the tubular section 18 of the encapsulation 14. The protrusion 84 is of a generally square or rectangular configuration. As can be seen, the protrusion 84 is received in receptacle area 74 between the abutment surface 66 and the locking member 68. A side of the protrusion 84 will reside in close proximity to a portion of the slide surface 64.

Figure 6:
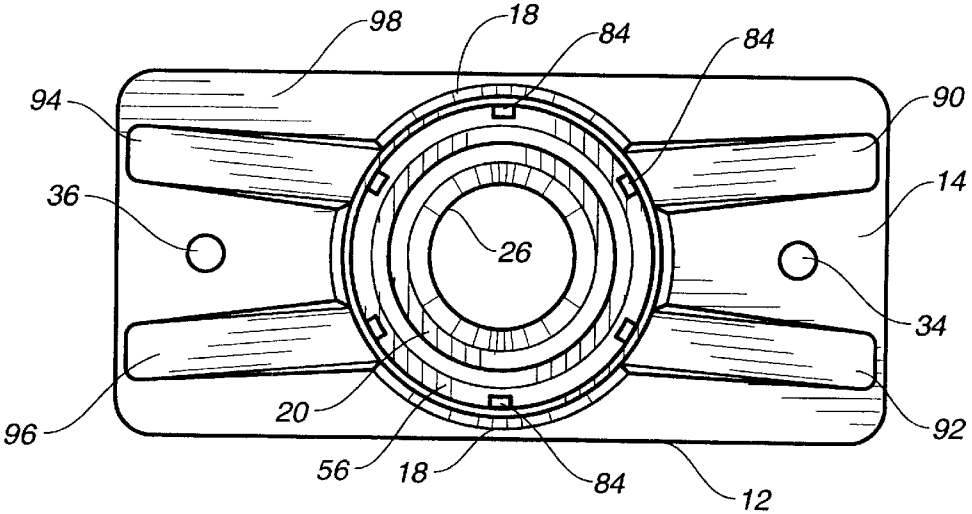
FIG. 6 is an end view of the anchor member of the present invention without the cap attached thereto.

FIG. 6 illustrates an end view of the anchor member 12 with the encapsulation 14 extending therearound. It can be seen that the anchor member 12 and the encapsulation 14 has tubular section 18 extending outwardly therefrom. The wedge cavity 26 is formed on the interior of the anchor member 12. Gussets 90, 92, 94 and 96 extend from the surface 98 of the anchor member 12 toward the tubular section 18. These gussets 90, 92, 94 and 96 provide structural strength to the anchor member 12. Holes 34 and 36 extend through the anchor member 12 and through the encapsulation 14.

Importantly, in FIG. 6, it can be seen that the protrusions 84 extend inwardly of the tubular section 18. Each of the protrusions 84 are evenly spaced from an adjacent protrusion. The positions of the protrusions 84 will correspond to the positions of the receptacle areas 74 formed on each of the locking mechanisms 62. It can be seen that the compressible seal 56 is an annular surface which extends around the end face 20 of the anchor member 12.

With reference to FIGS. 5 and 6, the cap member 16 is installed within the encapsulation 14 by initially inserting the flanged end 32 into the tubular section 18. The locking mechanisms 62 should be placed between each of the protrusions 84 during the insertion of the cap 16 into the tubular section 18. The cap 16 is then pressed inwardly so as to compress the seal 56. The cap is then rotated such that the protrusions 84 will pass over the spearhead shape of the locking member 64 and will enter the receptacle area 74. The cap can then be released such that the compressible seal 56 pushes the protrusions 84 into locking engagement within the receptacle area 74. As such, a positive and strong connection is established between the cap 16 and the encapsulation 14 so as to cover the wedge-receiving cavity 26 and the face 20 of the anchor member 12.

If it is desired to remove the cap 16, then it is only necessary to push inwardly with suitable strength and rotate in an opposite direction. The cap can then be pulled from the tubular section 18.

The present invention provides a strong positive seal between the cap 16 and the encapsulation 14 of anchor member 12. Inspection can be carried out easily by simply pulling on the end of the cap. If the cap does not slide outwardly of the tubular section 18, then the cap has been properly installed. If the cap is properly installed, then it is assured that a liquid-tight seal has occurred between the annular surface 80 of the cap 16 and the surface of the seal 56. The strong positive connection between the cap and the encapsulation prevents accidental dislodgement during use.

In the present invention, the cap 16 can also include a suitable corrosion-inhibitor fluid therein. The tubular portion 48 of the cap 16 can have a suitable length so as to accommodate the exposed end of the tendon. The number of locking mechanisms 62 as extending around the circumferential surface 60 can be varied as required for strength and stability.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A cap for an anchor of a post-tension anchorage system, the cap having a generally tubular body with an open end and a closed end and an outwardly flanged end adjacent the open end, the improvement comprising:

a locking means formed on a circumferential surface of the flanged end, said locking means for detachably engaging at least one protrusion extending inwardly of an end of the anchor, said locking means comprising:

at least one receptacle area formed on said circumferential surface, said receptacle area of said locking means comprising:

a slide surface;

an abutment member connected to one end of said slide surface; and a locking member formed on an other end of said slide surface opposite said abutment member.

2. The improved cap of claim 1, said slide surface having an edge extending from a portion of said circumference of said flanged end, said slide surface being in plane parallel relationship to an edge of said open end.

3. The improved cap of claim 1, said locking member having a spearhead shape, said spearhead shape having a wide end facing said abutment member, said receptacle area defined by said wide end and by said abutment member and by a portion of said slide surface extending between said wide end and said abutment member.

4. The improved cap of claim 1, said locking means comprising:

a plurality of receptacle areas formed around said circumferential surface, said plurality of receptacle areas being evenly spaced from each other around said flanged end.

5. The improved cap of claim 1, said circumferential surface having a forward edge aligned with the open end, said circumferential surface having a rearward edge between the open end and the closed ends said circumferential surface having a diameter greater than a diameter of the tubular body, said slide surface being spaced from and in plane parallel relation to said forward edge, said abutment member extending from said slide surface to said rearward edge.

6. An anchor for a post-tension anchorage system comprising:

an anchor member having an end surface;

a polymeric encapsulation covering said anchor member, said polymeric encapsulation having a tubular section extending outwardly of said end surface, said tubular section having at least one inwardly extending protrusion;

a cap having a generally tubular body with an open end and a closed end, said cap having a flanged end adjacent said open end, said flanged end having a circumferential surface; and a locking means formed on said circumferential surface, said locking means for detachably engaging said protrusion such that said flanged end is fixedly received within said tubular section, said locking means comprising:

at least one receptacle area formed on said circumferential surface, said receptacle area having a size slightly greater than said protrusions, said receptacle area of said locking means comprising:

a slide surface;

an abutment member connected to one of said slide surface; and a locking member formed on an other end of said slide surface opposite said abutment member.

7. The anchor of claim 6, further comprising:

a compressible seal affixed within said polymeric encapsulation and extending around said end surface.

8. The anchor of claim 7, said cap having an annular surface extending around said open end, said annular surface being in compressive contact with said compressible seal when said locking means engages said protrusion.

9. The anchor of claim 8, said compressible seal being an annular seal of an elastomeric material.

10. The anchor of claim 6, further comprising:

a tendon being affixed to said anchor member, said tendon having an end extending through said open end and into said tubular body of said cap.

11. The anchor of claim 6, said cap being in liquid-tight engagement with said polymeric encapsulation when said locking means engages said protrusion.

12. The anchor of claim 6, said slide surface having an edge extending from a portion of said circumference of said flanged end, said slide surface being parallel to an edge of said open end.

13. The anchor of claim 6, said locking member having a spearhead shape, said spearhead shape having a wide end facing said abutment member, said receptacle area defined by said wide end and by said abutment member and by a portion of said slide surface extending between said wide end and said abutment member.

14. The anchor of claim 6, said tubular section having a plurality of protrusions extending inwardly therefrom in generally evenly spaced relationship, said locking means comprising:

a plurality of receptacle areas formed around said circumferential surface, said plurality of receptacle areas being evenly spaced from each other around said flanged end, each of said plurality of receptacle areas receiving a separate one of said plurality of protrusions therein.

15. The anchor of claim 6, said circumferential surface having a forward edge aligned with said open end of said cap, said circumferential surface having a rearward edge between said open end and said closed end, said circumferential surface having a diameter greater than a diameter of said tubular body, said slide surface being spaced from and in parallel relation to said forward edge, said abutment member extending from said slide surface to said rearward edge.

* * * * *